United States Patent [19]

Rogozienski

[11] Patent Number: 4,832,632

[45] Date of Patent: May 23, 1989

[54] METHOD AND APPARATUS FOR GENERATING A HIGH PLUME OF WATER BEHIND A MARINE CRAFT

[76] Inventor: John J. Rogozienski, 2837 M Ave., National City, Calif. 92050

[21] Appl. No.: 50,745

[22] Filed: May 15, 1987

[51] Int. Cl.[4] ..... B63H 11/117

[52] U.S. Cl. ..... 440/39; 440/43; 60/222

[58] Field of Search ..... 440/38, 39, 40, 41, 440/42, 43, 113; 114/270; 441/71; 60/222

[56] References Cited

U.S. PATENT DOCUMENTS

| | | | |
|---|---|---|---|
| 2,940,091 | 6/1960 | Fifer | 441/71 |
| 3,077,616 | 2/1963 | Billingham | 441/71 |
| 3,339,516 | 9/1967 | Lenci | 440/39 |
| 3,981,262 | 9/1976 | DeVault et al. | 440/43 |
| 4,699,596 | 10/1987 | Klinker et al. | 440/39 |

*Primary Examiner*—Joseph F. Peters, Jr.

*Assistant Examiner*—Edwin L. Swinehart

*Attorney, Agent, or Firm*—Bruno J. Verbeck; Thomas R. Juettner

[57] ABSTRACT

A method and apparatus for generating a high plume or "rooster tail" of water behind a water jet propelled marine craft, such as a jet ski, is characterized by the insertion of a water diverting member into the upper regions of the jet of water discharging from the jet propulsion system and diverting a portion of the water from the jet upwardly and outwardly away from the jet to form a tall plume of water above and behind the jet. In its preferred embodiment, the apparatus comprises a lever pivotally mounted on the upper side of the discharge nozzle of the propulsion system and selectively movable at its upstream end through a slot in the nozzle into the interior of the nozzle to divert a portion of the water from the jet stream upwardly and rearwardly away from the nozzle.

14 Claims, 1 Drawing Sheet

METHOD AND APPARATUS FOR GENERATING A HIGH PLUME OF WATER BEHIND A MARINE CRAFT

TECHNICAL FIELD

The present invention relates to marine pleasure craft propelled by water jet propulsion systems, and particularly to a novel method and apparatus for generating a high plume or so called "rooster tail" of water behind such a marine craft.

BACKGROUND ART

Many marine pleasure craft are propelled by water jet propulsion systems comprising a prime mover, a high pressure pump driven by the prime mover, and a nozzle for receiving water from the pump, converting into a high energy liquid jet and discharging it from the rear or stern of the craft in such manner as to propel the craft at high speed through the water.

While such marine craft may take a variety of forms, from conventional boats to hybrid vehicles, a currently popular craft is the jet ski, an exemplary depiction of which may be found in U.S. Pat. No. 4,628,852, granted Dec. 16, 1986, to Nisida et al. In the operation of jet skis, considerable turbulence and white water are generated to the rear of the craft and when a sharp turn is made at high speed the craft causes a wall or plume of water to be thrown high into the air. The creation of such a plume of water, called a "rooster tail", contributes significantly to the enjoyment and exhilaration of the sport of jet skiing, just as it would to other forms of marine activities.

DISCLOSURE OF THE INVENTION

The object of the present invention is to provide a method and an apparatus that will permit the navigator of water jet propelled craft, such as a jet ski, to create a large and visually impressive water plume or rooster tail at will at any time the craft is in operation, without impairing the speed of the craft or requiring potentially dangerous high speed sharp turns or similar maneuvers, thereby to contribute significantly to the thrill and enjoyment of the sport.

Because the invention eliminates the need for dangerous maneuvers in order to create a plume or rooster tail, the invention can contribute to safer or at least more sane operation of jet skis. Also, the ability to generate a highly visible plume of water serves as a warning to alert other vessels, particularly larger vessels, of the presence in the water of far smaller craft, such as jet skis. Use of the apparatus of the invention can further produce hydrodynamic advantages in the maneuvering and functioning of small craft thereby additionally contributing to safe operation.

Consequently, while the prime object of the invention is to enhance the fun of jet skiing, the invention also contributes to the safety of operation of jet skis and similar craft.

The method of the invention resides in the steps of inserting a water diverting member into the upper regions of the jet of water discharging from the jet propulsion system of the craft and diverting a portion of the water from the jet upwardly and outwardly away from the jet to form a tall plume of water above and behind the craft. Sufficient water is diverted from the jet at a sufficiently high vertical angle to create a tall plume or rooster tail of water that is highly visible and visually impressive. Yet, not so much water is diverted as to impair or impede the forward speed of the craft. Also, the method contemplates selective insertion and removal of the water diverting member into and out of the jet stream of water so that the plume or rooster tail can be generated at will according to the whims or desires of the navigator.

The apparatus of the invention comprises diverter means movably mounted on the jet propulsion system of the marine craft adjacent the upper regions of the jet outlet from the system, the diverter means having an upstream inlet end adapted to be inserted into the upper regions of the jet of water discharging from the propulsion system and a downstream outlet end adjacent the upper peripheral edge of the jet, whereby the diverter means, upon insertion of its upstream end into the jet, diverts a portion of the water from the jet upwardly and outwardly away from the jet to form a high plume or column of water upwardly and rearwardly of the stern of the craft.

In its preferred embodiment, the apparatus of the invention comprises a lever pivotally mounted on the upper side of the discharge nozzle of the propulsion system and selectively movable at its upstream end through a slot in the nozzle into the interior of the nozzle to divert a portion of the water from the jet stream upwardly and rearwardly away from the nozzle. With this arrangement, by selectively swinging the lever into and out of the slot in the nozzle, the operator can turn the rooster tail "on" and "off" whenever desired.

By virtue of the method and apparatus of the invention, the fun of marine sports such as jet skiing can be significantly enhanced, and at the same time, the operator is provided with means that can contribute to his or her increased safety.

These and other objects and advantages of the invention will become apparent from the following detailed description, taken in conjunction with the accompanying drawings.

BEST MODE FOR CARRYING OUT THE INVENTION

The following is a description of the best mode presently known to the applicant for carrying out his invention.

Figure 1:
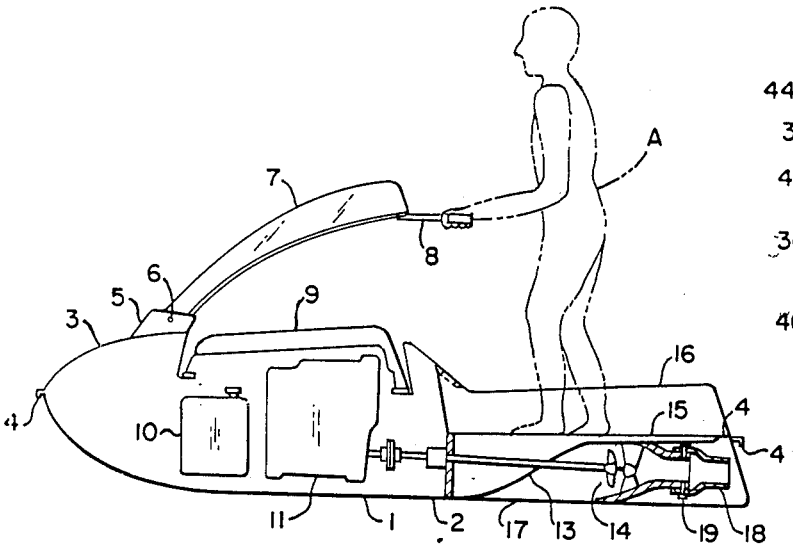
FIG. 1 is a schematic illustration in vertical longitudinal section of a type of marine craft, namely a jet ski, to which the invention has particularly useful application.
Figure 4:
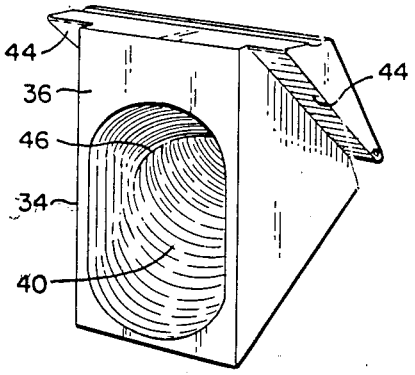
FIG. 4 is a perspective view, from the front and side, of the water diverting member of said device.
Figure 2:
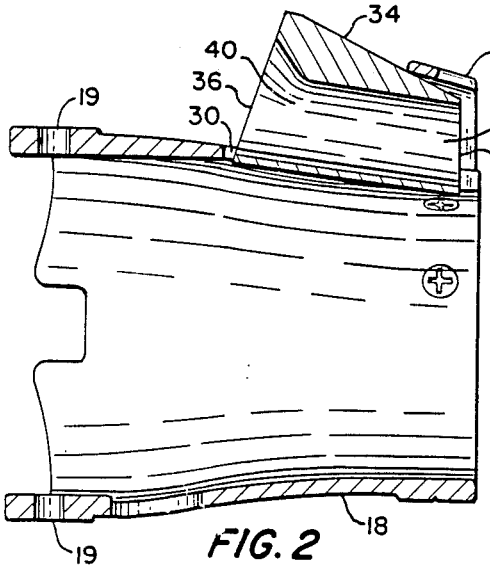
FIG. 2 is a vertical longitudinal sectional view of a water jet propulsion system outlet nozzle equipped with a preferred embodiment of the "rooster tail" generating device of the invention.

FIG. 1 is a schematic illustration of a small sized marine craft, called a jet ski, which can freely skim over the water surface and is controlled by a navigator A in a standing or kneeling position. A craft body 1 is composed of a hull 2 constituting the lower portion of the body and a deck 3 constituting the upper part thereof, which parts are bonded together through flanges 4 formed at the respective peripheral edges of the hull 2 and the deck 3. A handle pole bracket 5 is secured to a fore portion of the deck 3. A handle pole 7 is mounted on the bracket 5 through a mounting shaft 6 such as to be pivotal vertically. A handle lever 8 is secured to the handle pole 7. Thus, the navigator A may control the craft by actuating the handle lever 8. An engine cover 9 covers a fuel tank 10 and an engine 11 which are installed inside the body 1. The engine cover 9 is detachably secured to the deck 3 to accomodate convenient access to the fuel tank and the engine.

A duct 13 is provided at the lower side of an aft or rear portion of the craft body 1. A water jet propeller 14 is mounted in the duct 13. The water jet propeller 14 is driven by the engine 11, whereby a propulsive force is obtained. A floor 15 is provided in an aft portion of the deck 3. The floor 15 is designed such as to allow the navigator A to ride comfortably thereon. On both sides of the floor 15, upwardly projecting fins 16 are provided to define the navigator's cockpit or operating station for the marine craft.

When the water jet propeller 14 is driven by the engine 11, water from the body of water on which the craft is floating is drawn into the inlet 17 of the water duct 13 and discharged through the propeller into an outlet nozzle 18 where the water is converted into a coherent high pressure jet designed to propel the craft through the water at various speeds dependent upon the speed of the engine and the propeller. The speed of the engine is governed by the navigator through conventional manual controls on the handle lever 8. In the embodiment illustrated, the craft is steered by pivoting the jet discharge nozzle 18 in a horizontal arc about a vertical axis defined by mounting pins 19. For steering purposes, a cable or the like (not shown) extends between the navigator's handle lever 8 and a horizontally extending lever arm 20 on the steering nozzle 18.

The discharge end of the steering nozzle 18 is formed by an essentially cylindrical wall. In accordance with the present invention, a slot 30 is cut through the upper portion of the nozzle wall and extends axially inward or upstream in the direction of water flow from the discharge or outlet end of the nozzle. Secured to the exterior of the nozzle wall at the outlet end of the nozzle is a bracket 32 having an inverted U-shaped portion which overlies the discharge end portion of the slot 30 and extends radially upward from the nozzle wall. Pivotally mounted within the U-shaped portion of the bracket is a water diverter 34.

In the illustrated embodiment, the water diverter 34 comprises a block shaped lever having an upstream end 36 and a downstream end 38, and a hole 40 extending generally axially through the block between the two ends thereof. The downstream end 36 of the lever block 34 is pivotally mounted within the inverted U-shaped portion of the bracket 32 in such position that the radially inward surface of the downstream end of the lever block is located substantially at the interior peripheral surface of the wall of the nozzle 18, the pivotal mounting of the lever block being accomplished by pivot pins 42 extending through the bracket and into the side walls of the block adjacent its downstream end.

By virtue of the pivotal mounting, the upstream end of the lever block 34 is swingable through the slot 30 into and out of the interior of the nozzle to establish and disestablish communication between the interior of the nozzle and the upstream end of the hole 40 through the diverter block. To limit movement of the block into the interior of the nozzle solely to the desired degree, the radially outer or upper surface of the block is provided with laterally extending flanges 44 which engage the exterior surface of the nozzle and limit inward movement to a position wherein the upstream end of the hole 40 is in full, open communication with the interior of the nozzle slightly inwardly of the interior peripheral surface of the nozzle wall.

As to outward movement of the diverter lever 34, it is desirable not only to accomodate but also to limit movement to a position wherein the radially inner surface of the lever forms a continuation of the inner surface of the nozzle wall so as not to interfere with proper functioning of the nozzle when it is intended that the craft operate in its usual or conventional manner. To this end, the lever block 34 and its mounting bracket 32 are shaped and dimensioned such that when the radially inner surface of the lever is aligned with the inner surface of the wall of the nozzle, the upper surface of the lever engages the bight of the inverted U-shaped portion of the bracket and forms a limit stop preventing further outward movement of the upstream end of the lever.

Thus, when the lever is swung to its outward-most position, the configuration of the interior of the discharge end of the jet nozzle 18 is its usual circular configuration and the jet ski or other craft will function entirely in its usual or customary fashion. However, when the craft is operating at normal speed and the lever is swung into its innermost position, the upstream end thereof will be immersed in the jet stream of water passing through the nozzle and a portion of the water will be diverted through the hole 40 in the block 34 and will be discharged as a column of water at high velocity through the outlet or downstream end of the hole. Due to the radially outward, upward inclination of the hole in the downstream or rearward direction, this column of water will be directed upwardly and rearwardly away from the craft and, in its course of travel, will expand and break up or atomize into a tall plane of water spray forming a "rooster tail" behind the craft. Depending upon the size and degree of inclination of the hole 40 and the speed of the craft, the rooster tail can be made to vary in characteristics. In the illustrated embodiment, the apparatus of the invention, when mounted on a jet ski, will readily produce a rooster tail 13 feet high and 50 feet long.

The ability to create such a rooster tail contributes to the fun and exhilaration of the jet skiing, and also the aesthetic enjoyment of those watching a jet ski event. Due to the fact that the diverter 34 is on the steering nozzle 18 of the craft, particularly aesthetic spray patterns can be generated by appropriate manipulation of the craft and its steering nozzle. In addition, the water plume or rooster tail greatly increases the visibility of very small craft to alert larger craft of the presence of the smaller craft. Moreover, the reaction forces from the upward ejection of a high pressure column of water will tend to force a small craft more firmly against the body of water on which it is being navigated, thereby to contribute to the degree of control the navigator can exercise over the craft.

In order to increase the velocity of the column of water discharged from the diverter block 34, thereby to enhance the height and length of the water plume formed thereby, the hole 40 preferably has a large area opening at its upstream inlet end and a smaller area opening at its downstream outlet end, with an intervening streamline transition zone 46 for increasing the velocity of the water in its passage through the hole. In the preferred embodiment, the outlet end of the hole is a relatively small diameter circle and the inlet end thereof is of generally eliptical form, with the minor axis of the elipse in the horizontal plane and equal to the diameter of the outlet hole with the major axis of the elipse in the vertical plane so as to minimize the width of the diverter. Between the two ends of the hole, there is a smooth gradual transition zone 46, defined principally along the upper margin of the hole, to increase the velocity of the water in its passage through the hole.

While the preferred embodiment of the invention embodies a block shaped water diverting lever 34 with a water column forming hole 40 through it, it will be manifest from the foregoing description that for performance of the basic function of water diversion a plane flat lever conforming generally to the lower margins of the block 34 would suffice to throw up a plume, though probably not as high or as well defined as with the preferred embodiment. If a plane flat lever were used, its performance would be enhanced by forming a pair of side walls or a lever receiving channel on either the lever or the interior surface of the nozzle 18 thereby to simulate to a degree the hole 40 of the preferred embodiment. In any event, it is manifest that the water diverting member may take forms other than that of the preferred embodiment herein illustrated and described.

To facilitate operation of the rooster tailing device at the will or whim of the navigator, and as frequently or infrequently as may be desired, the device is preferably provided with operating means conveniently located in the navigator's cockpit. According to the invention, either one or both of two operating means may be provided at the operating station, namely, a hand actuated lever mounted on the handle pole 7 or lever 8 and a foot or knee actuated button in the floor 15. With either operating means, the rooster tailing device is preferably normally biased to its "off" position and actuated to its "on" position by the operating means, thereby to facilitate most convenient control over use of the rooster tailing device.

For the purpose, both the bracket 32 and the diverter 34 are provided with lateral extensions 48 and 50, respectively, forwardly of the pivot axis 42 of the diverter 34. A compression spring 52 or similar resilient biasing means is confined between the two extensions 48 and 50 thereby to bias the upstream end of the diverter lever 34 to its radially outward or "off" position. To move the upstream end of the lever 34 into the interior of the nozzle to its "on" position, one or the other or both of two actuating means may be provided.

The first actuating means, indicated generally at 54, comprises a flexible cable of the well known type comprising an exterior sleeve 56 and an inner wire 58. The sleeve 56 is attached at one end to the bracket extension 48 at the lower side thereof and the wire 58 extends upwardly through the bracket extension 48, the spring or biasing means 52 and the diverter extension 50; the cable being secured in fixed position on the diverter extension 50 by a set screw 60 or the like. The other end of the cable is conducted in any appropriate and well known manner through the body of the craft to the handle pole 7 and lever station 8 of the craft where it is connected in known manner to a hand operated squeeze lever 62. Thus, by squeezing the lever 62, the navigator can swing the diverter 34 into its "on" position to create a rooster tail and by releasing the lever can permit the diverter to be returned by the spring 52 to its "off" position to discontinue the rooster tail.

Figure 3:
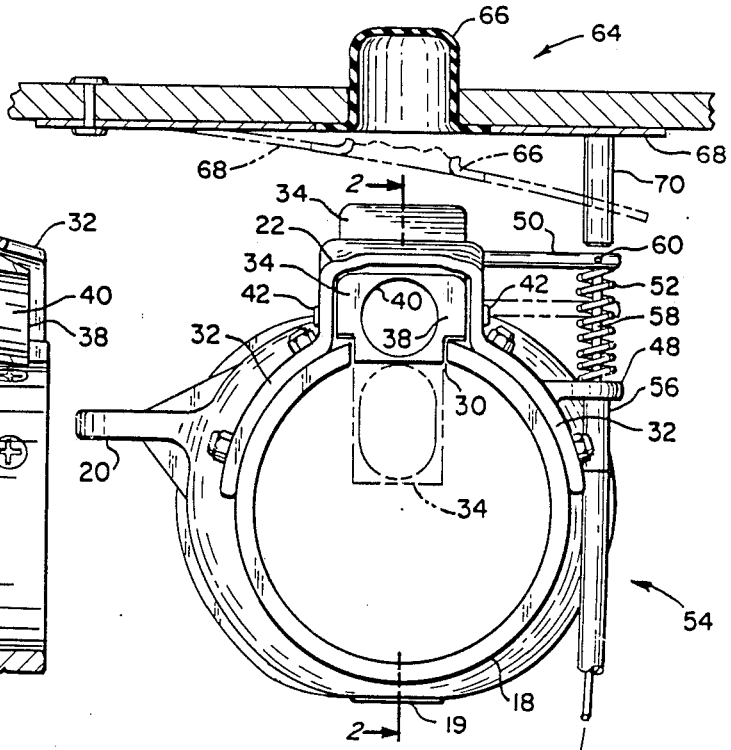
FIG. 3 is a rear elevation of the nozzle and associated device illustrated in FIG. 2 together with actuating means for the device.
Figure 3:
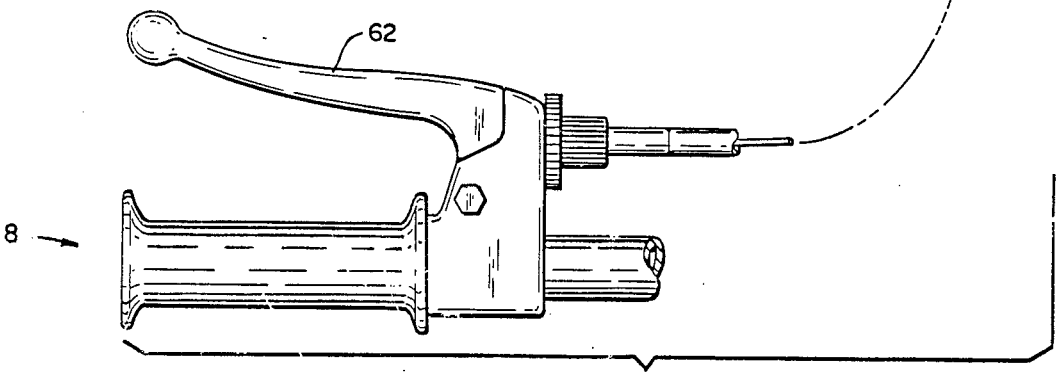

The second actuating means, indicated generally at 64, comprises a push button 66 located on the floor 15 of the craft above the diverter lever 34 in a position where it can conviently be depressed by the knee or foot of the navigator, depending upon the navigator's posture in the cockpit. Specifically, the button 66, which is resiliently covered for the comfort of the navigator, extends downwardly through a hole in the floor 15 and is secured to a flexible plate 68 which is secured to the underside of the floor 15 to hold the button in place. Either the button 66 itself or a movable portion of the mounting plate 68 is positioned above the diverter lever 34 at a location forwardly or upstream from the pivot axis 42 of the lever. Alternatively, as shown in FIG. 3, the free end of the plate 68 may be operatively connected to the lateral extension 50 on the block 34 by a pin 70 or the like for effecting pivotal movement of the upstream end of the block. Consequently when the navigator depresses the button, the upstream end of the diverter is swung into its "on" position in the interior of the nozzle 18, and when the navigator releases the button, the diverter and the button are returned to their normal or "off" position by the spring 52.

Thus, the rooster tail diverter member is under the instaneous control of the navigator from his/her normal posture in the cockpit of the craft. The diverter can be turned on or off at will without requiring any change in the navigator's posture, thereby to ensure continued safe operation of the craft.

While the preferred embodiment of the method and apparatus of the invention have been herein illustrated and described, it is to be appreciated that various changes and modifications may be made therein without departing from the scope of the invention, as defined by the appended claims.

I claim:

1. Apparatus for generating a plume of water from the discharge of a water jet propulsion system comprising diverter means located adjacent the upper region of the jet of water discharging from the propulsion system, said diverter means having a lower inlet end extending into the upper region of the discharging jet of water and being upwardly inclined in the direction of water flow for diverting a portion of the water from the jet upwardly and outwardly away from the jet to form a plume of water above the jet, said diverter means being movably mounted on the propulsion system for movement between a position wherein its inlet end extends into the discharging jet of water and a position wherein it is outside the jet, whereby said diverter means is selectively operable for plume generation.

2. Apparatus for generating a plume of water behind a water jet propelled marine craft, comprising a generally horizontally disposed water jet discharge nozzle and a diverter means mounted on and extending into the upper regions of the path of jet flow of water through the nozzle, said diverter means, in the direction of water flow through the nozzle, having a lower upstream inlet end communicating with the interior of the nozzle in the upper regions thereof and an upper downstream outlet end communicating to the exterior of the nozzle whereby upon jet flow of water through the nozzle said diverter means diverts a portion of the discharging jet of water upwardly and rearwardly of the craft to form a generally vertical plume of water behind the craft.

3. Apparatus as set forth in claim 2, wherein said water jet discharge nozzle is adapted to be movably mounted on the craft and to comprise means for steering the craft.

4. Apparatus as set forth in claim 2, wherein said diverter means is adjustably mounted on said nozzle for movement between a position wherein it diverts a portion of the discharging jet of water upwardly and outwardly away from the nozzle and a position wherein none of the water is diverted from the jet, whereby said diverter means is selectively operable for generation of a plume of water.

5. Apparatus as set forth in claim 2, wherein said nozzle has a wall with a slot in it adjacent its discharge end, and said diverter means is movably mounted on the wall of the nozzle for movement of its inlet end through said slot into and out of the interior of the nozzle.

6. Apparatus as set forth in claim 5, wherein said diverter means is pivotally mounted adjacent its downstream end on the wall of said nozzle and is pivotally movable from a position wherein its upstream end extends into the interior of the nozzle to a position wherein the diverter forms a continuation of the nozzle wall.

7. Apparatus as set forth in claim 2, wherein said nozzle has a wall with a slot extending through its upper surface adjacent its discharge end and includes mounting means on said wall adjacent the downstream end of the slot, and said diverter means comprises a lever pivotally mounted adjacent its downstream end on said mounting means for pivotal movement of its upstream end through said slot into and out of the interior of said nozzle.

8. Apparatus as set forth in claim 7, including means effectively defining walls on both sides of the upstream end of said lever for forming a column of water to be diverted from the jet stream by said lever.

9. Apparatus as set forth in claim 7, wherein said lever comprises a block shaped member pivotally mounted on said mounting means and having a hole extending therethrough from its upstream end to its downstream end, said block being mounted with its downstream end at the exterior of the wall of said nozzle and its upstream end pivotally movable through said slot into and out of the interior of the nozzle for establishing and disestablishing communication between the upstream end of said hole and the interior of said nozzle.

10. Apparatus as set forth in claim 9, wherein the hole through said block shaped member is of larger area at its upstream end than at its downstream end.

11. Apparatus as set forth in claim 10, wherein the hole through said block shaped member is of elliptical shape at its upstream end and of circular shape at its downstream end and includes therebetween an intermediate transition zone of progressively decreasing area.

12. Apparatus as set forth in claim 7, including resilient means between said mounting means and said lever for normally biasing said lever to one end of its path of pivotal movement, and means for moving said lever toward the other end of its path of pivotal movement.

13. Apparatus as set forth in claim 12, wherein the marine craft has an operator control station and said means for moving said lever comprises a remote actuated cable extending from said lever to the operator control station of the craft.

14. Apparatus as set forth in claim 12, wherein the marine shaft has an operator control station having a floorboard and said means for moving said lever comprises a depressable button extending from said lever through the floorboard to the operator control station of the craft.

* * * * *